US010808974B2

(12) United States Patent
Govekar et al.

(10) Patent No.: US 10,808,974 B2
(45) Date of Patent: Oct. 20, 2020

(54) APPARATUS AND METHOD FOR DUAL REFRIGERANT TANK REFILL

(71) Applicant: Snap-on Incorporated, Kenosha, WI (US)

(72) Inventors: Craig F. Govekar, Gurnee, IL (US); Rahhali Sanhaji, Sesto Fiorentino (IT); Paolo Pennacchia, Florence (IT); Massimo Corposanto, Sesto Fiorentino (IT)

(73) Assignee: Snap-on Incorporated, Kenosha, WI (US)

( * ) Notice: Subject to any disclaimer, the term of this patent is extended or adjusted under 35 U.S.C. 154(b) by 107 days.

(21) Appl. No.: 15/973,085

(22) Filed: May 7, 2018

(65) Prior Publication Data

US 2019/0186796 A1 Jun. 20, 2019

(30) Foreign Application Priority Data

Dec. 20, 2017 (IT) ..... 102017000147496

(51) Int. Cl.
*F25B 45/00* (2006.01)
*F25B 43/00* (2006.01)
*F25B 7/00* (2006.01)

(52) U.S. Cl.
CPC ..... *F25B 45/00* (2013.01); *F25B 7/00* (2013.01); *F25B 43/006* (2013.01);
(Continued)

(58) Field of Classification Search
CPC ..... F25B 45/00; F25B 2345/001; F25B 2345/002; F25B 2345/004;
(Continued)

(56) References Cited

U.S. PATENT DOCUMENTS 4,513,578 A 4/1985 Proctor et al.
4,688,388 A 8/1987 Lower et al.
(Continued)

FOREIGN PATENT DOCUMENTS

EP 3040652 A1 7/2016
JP 2016-200357 A 12/2016
(Continued)

OTHER PUBLICATIONS

Bacharach, Inc.; Stinger Refrigerant Recovery Unit; User Manual 2090-0217 Rev. 6; Apr. 2012.
(Continued)

*Primary Examiner* — Frantz F Jules
*Assistant Examiner* — Lionel Nouketcha
(74) *Attorney, Agent, or Firm* — McDonnell Boehnen Hulbert & Berghoff LLP

(57) ABSTRACT

A dual tank refrigerant delivery apparatus including a refrigerant tank housing a first storage tank, a second storage tank, and a refrigerant delivery system positioned therein, the refrigerant delivery system adapted to supply a first refrigerant to the first storage tank and a second refrigerant to the second storage tank, a tank recess on the housing for receiving a refrigerant resupply tank, a first refrigerant hose for connecting to a first refrigerant resupply tank, a second refrigerant hose for connecting to a second refrigerant resupply tank, wherein the first refrigerant is supplied from the first refrigerant resupply tank through the first refrigerant hose and refrigerant delivery system to the first storage tank, and wherein the second refrigerant is supplied from the second refrigerant resupply tank through the second refrigerant hose and refrigerant delivery system to the second storage tank.

20 Claims, 9 Drawing Sheets

(52) U.S. Cl.
CPC ... *F25B 2345/001* (2013.01); *F25B 2345/002* (2013.01); *F25B 2345/004* (2013.01); *F25B 2345/0052* (2013.01); *F25B 2400/121* (2013.01); *F25B 2400/23* (2013.01)

(58) Field of Classification Search
CPC ..... F25B 2345/0052; F25B 2400/23; F25B 43/006; F25B 7/00
See application file for complete search history.

(56) References Cited

U.S. PATENT DOCUMENTS

| | | | | |
|---|---|---|---|---|
| 5,095,713 | A * | 3/1992 | Laukhuf | F25B 45/00 62/149 |
| 5,172,562 | A | 12/1992 | Manz et al. | |
| 5,193,351 | A | 3/1993 | Laukhuf et al. | |
| 5,493,869 | A * | 2/1996 | Shirley | B60H 1/00585 141/248 |
| 5,802,859 | A * | 9/1998 | Zugibe | F25B 45/00 62/125 |
| 6,119,475 | A | 9/2000 | Murray et al. | |
| 6,185,945 | B1 * | 2/2001 | Pfefferle | B60H 1/00585 62/149 |
| 6,655,407 | B1 * | 12/2003 | Dudley | F16L 41/065 137/318 |
| 7,254,954 | B2 | 8/2007 | Govekar et al. | |
| 7,310,956 | B2 | 12/2007 | Meldahl et al. | |
| 7,310,965 | B2 | 12/2007 | Govekar | |
| 7,905,095 | B2 | 3/2011 | Suharno et al. | |
| 8,572,992 | B2 * | 11/2013 | Murray | B60H 1/00585 62/149 |
| 9,366,488 | B2 | 6/2016 | Sanhaji | |
| 9,759,464 | B2 * | 9/2017 | Sanhaji | F25B 45/00 |
| 2009/0158756 | A1 * | 6/2009 | Brown | B60H 1/00585 62/77 |
| 2011/0203675 | A1 | 8/2011 | Rahhali | |
| 2013/0284277 | A1 | 10/2013 | Rahhali | |
| 2013/0312434 | A1 * | 11/2013 | Sanhaji | F25B 45/00 62/77 |
| 2017/0191719 | A1 * | 7/2017 | Plasek | F25B 45/00 |
| 2018/0164008 | A1 | 6/2018 | Sanhaji | |

FOREIGN PATENT DOCUMENTS

| | | | |
|---|---|---|---|
| WO | 2014165248 | A1 | 10/2014 |
| WO | 2018007416 | A1 | 1/2018 |

OTHER PUBLICATIONS

Bosch Automotive Service Solutions LLC; Recovery/Recycling/Recharging Unit Operating Manual, Model 17800B / 17801B; Sep. 9, 2013.
Bosch Automotive Service Solutions LLC; Operating Manual for Model 34988 Recovery, Recycling, Recharging Unit; 554228 Rev. E; Jul. 30, 2013.
Snap-On Incorporated; Air Conditioning Equipment and Tools 2010 Catalog; Feb. 24, 2010.
Snap-On Incorporated; Service Center, A/C, ECO Plus, R134a; downloaded from the World Wide Web at https://store.snapon.com/ECO-Plus-A-C-Service-Center_R134a-Service-Center-A-C-ECO-trade-Plus-R134a-P6478708.aspx; Mar. 21, 2016.
Propane 101; Promoting Propane Safety Through Better Understanding; downloaded from the World Wide Web at http://www.propane101.com/consumerlpgcylinderparts.htm; Jun. 27, 2016.
Mastercool, Inc.; Mastercool ECK1800 user manual—downloaded from the world wide web at http://www.mastercool.com/wp-content/uploads/2015/03/copia_di_d000004039_0002_0001.pdf; Mar. 2015, pp. 1-39 (English).
Snap-On Incorporated; ECO Xtreme User's Manual, Mar. 7, 1997.
Snap-On Incorporated; A/C Equipment and Tools; Are you Ready for A/C Season?; Mar. 26, 2013.
Italian Search Report, Italian Application No. IT201700147496, dated Sep. 11, 2018, 11 pages, p. 6-11 in English.
European Search Report, European Patent Application No. 18214750.4, dated May 15, 2019, 10 pages.

* cited by examiner

APPARATUS AND METHOD FOR DUAL REFRIGERANT TANK REFILL

BACKGROUND

This application claims priority to Italian Application No. 102017000147496 entitled "Apparatus and Method for Dual Refrigerant Tank Refill" filed on Dec. 20, 2017, the contents of which are incorporated by reference herein in their entirety.

Many vehicles come equipped with systems that utilize refrigerants, such as air conditioning systems, for example. The refrigerant (1,1,1,2-tetrafluoroethane-R-134a, for example) has been widely used in such systems and may need to be supplemented, recycled, or removed on occasion. However, the R-134a refrigerant is being phased out and for newer vehicle models, the refrigerant 2,3,3,3-tetrafluoroprene-R-1234yf is coming into more widespread use. In order to add or remove the refrigerant (whether R-134a or R-1234yf, or some other refrigerant), refrigerant delivery and recovery units can be used.

Refrigerant delivery and recovery units can be equipped with a storage tank for storing refrigerant. In order to provide a source of refrigerant for different vehicles requiring different types of refrigerant, it would be desirable to provide a refrigerant delivery and recovery unit having two sources (e.g., two tanks) of refrigerant (e.g., R-134a and R-1234yf) to accommodate vehicles having different refrigerant requirements. In addition, it would also be desirable to provide a refrigerant delivery and recovery unit having the capability of refilling or replenishing either refrigerant tank when the refrigerant runs low or is depleted in either of the refrigerant tanks.

SUMMARY

The present disclosure provides a refrigerant delivery and recovery unit that advantageously includes two or more separate tanks for storing distinct types of refrigerant, such as R-134a and R-1234yf refrigerant. In one embodiment, a refrigerant delivery and recovery unit is provided having a dual tank configuration with a first tank for storing a first type of refrigerant (e.g. R-134a) and a second tank for storing a second type of refrigerant (e.g. R-1234yf). As a result, the dual tank configuration provides that the refrigerant delivery and recovery unit has a supply of two distinct types of refrigerant to deliver to a vehicle requiring either the first type of refrigerant (e.g. R-134a) or the second type of refrigerant (e.g. R-1234yf). In addition, the refrigerant delivery and recovery unit advantageously provides for an additional refrigerant resupply tank that may be used to supply either the first or second tank with the appropriate refrigerant. Furthermore, the refrigerant delivery and recovery unit further includes safeguards for insuring that only the proper type of refrigerant is supplied to the first or second tank during the process of resupplying the first or second tank with refrigerant.

The present disclosure further provides for a method of resupplying a refrigerant delivery and recovery unit having a first tank containing a first type of refrigerant (e.g. R-134a) and a second tank containing a second type of refrigerant (e.g. R-1234yf) from a refrigerant resupply tank. The method further includes safeguards for insuring that only the proper type of refrigerant (e.g. R-134a or R-1234yf) is resupplied to the first or second tank during the process of resupplying the first or second tank with refrigerant In one aspect, a refrigerant delivery and recovery unit is provided having a refrigerant tank housing, a first storage tank positioned within the refrigerant tank housing, a second storage tank positioned within the refrigerant tank housing, a refrigerant delivery system positioned within the refrigerant tank housing, the refrigerant delivery system adapted to supply a first refrigerant to the first storage tank and a second refrigerant to the second storage tank, a tank recess on the housing for receiving a refrigerant resupply tank therein, a first refrigerant hose having a first fitting adapted for connection to a first refrigerant resupply tank, a second refrigerant hose having a first fitting adapted for connection to a second refrigerant resupply tank, wherein the first refrigerant hose is adapted for connection to the refrigerant delivery system, wherein the second refrigerant hose is adapted for connection to the refrigerant delivery system, wherein the first refrigerant hose is further adapted to supply the first refrigerant to the refrigerant delivery system from the first refrigerant resupply tankthank, and wherein the second refrigerant hose is further adapted to supply the second refrigerant to the refrigerant delivery system from the second refrigerant resupply tank.

Viewed from another aspect, an example embodiment takes the form of a method. The method includes steps of (i) providing a refrigerant supply unit having a refrigerant tank housing having a first storage tank positioned within the refrigerant tank housing and a second storage tank positioned within the refrigerant tank housing, a refrigerant delivery system positioned within the refrigerant tank housing, the refrigerant delivery system adapted to supply a first refrigerant to the first storage tank and a second refrigerant to the second storage tank, a tank recess on the housing for receiving a refrigerant resupply tank therein, a first refrigerant hose having a first fitting adapted for connection to a first refrigerant resupply tank, a second refrigerant hose having a first fitting adapted for connection to a second refrigerant resupply tank, wherein the first refrigerant hose is adapted for connection to the refrigerant delivery system, wherein the second refrigerant hose is adapted for connection to the refrigerant delivery system, wherein the first refrigerant hose is further adapted to supply the first refrigerant to the refrigerant delivery system from the first refrigerant resupply tank, and wherein the second refrigerant hose is further adapted to supply the second refrigerant to the refrigerant delivery system from the second refrigerant resupply tank; (ii) securing a first refrigerant resupply tank containing the first refrigerant within the tank recess; (iii) attaching the first fitting of the first refrigerant hose to the first refrigerant resupply tank, and attaching the second fitting of the first refrigerant hose to a first fitting on the refrigerant delivery system, wherein the first refrigerant hose is connected to the refrigerant delivery system and the refrigerant delivery system is connected to the first storage tank; and (iv) supplying the first refrigerant from the first refrigerant resupply tank through the first refrigerant hose and the refrigerant delivery system to the first storage tank The method may further include the steps of (v) disconnecting the first refrigerant resupply tank from the first refrigerant hose and removing the first refrigerant resupply tank from the tank recess; (vi) securing a second refrigerant resupply tank containing a second refrigerant within the tank recess; (vii) attaching the first fitting of the second refrigerant hose to the second refrigerant resupply tank, wherein the second refrigerant hose is connected to the refrigerant delivery system and the refrigerant delivery system is connected to the second storage tank; and (viii) supplying the second refrigerant from the second refrigerant resupply tank through the second refrigerant hose and the refrigerant delivery system to the second storage tank.

Further, a means for resupplying first and second storage tanks containing different types of refrigerant with the proper refrigerant during a process of resupplying the first or second tank with refrigerant is provided.

These as well as other aspects and advantages will become apparent to those of ordinary skill in the art by reading the following detailed description, with reference to the accompanying drawings. Further, it should be understood that the embodiments described in this overview and elsewhere are intended to be examples only and do not necessarily limit the scope of the invention.

BRIEF DESCRIPTION OF THE DRAWINGS

Example embodiments are described herein with reference to the following drawings.

DETAILED DESCRIPTION

In this description, the articles "a," "an," and "the" are used to introduce elements and/or functions of the example embodiments. The intent of using those articles is that there is one or more of the introduced elements and/or functions. In this description, the intent of using the term "and/or" within a list of at least two elements or functions and the intent of using the terms "at least one of" and "one or more of" immediately preceding a list of at least two elements or functions is to cover each embodiment including a listed element or function independently and each embodiment comprising a combination of the listed elements or functions. For example, an embodiment described as comprising "A, B, and/or C," or "at least one of A, B, and C," or "one or more of A, B, and C" is intended to cover each of the following possible embodiments: (i) an embodiment comprising A, but not B and C, (ii) an embodiment comprising B, but not A and C, (iii) an embodiment comprising C, but not A and B, (iv) an embodiment comprising A and B, but not C, (v) an embodiment comprising A and C, but not B, (v) an embodiment comprising B and C, but not A, and (vi) an embodiment comprising A, B, and C. For the embodiments comprising element or function A, the embodiments can comprise one A or multiple A. For the embodiments comprising element or function B, the embodiments can comprise one B or multiple B. For the embodiments comprising element or function C, the embodiments can comprise one C or multiple C. In this description, the use of ordinal numbers such as "first," "second," "third" and so on is to distinguish respective elements rather than to denote a particular order of those elements unless the context of using those terms explicitly indicates otherwise.

The diagrams, flow charts, and data shown in the figures are provided merely as examples and are not intended to be limiting. Many of the elements illustrated in the figures and/or described herein are functional elements that can be implemented as discrete or distributed elements, individually or in conjunction with other element(s), and in any suitable combination and/or location. Those skilled in the art will appreciate that other arrangements and elements can be used instead. Furthermore, the functions described as being performed by one or more elements can be carried out by a combination of hardware, firmware, and/or software (e.g., a processor that executes computer-readable program instructions).

Figure 1A:
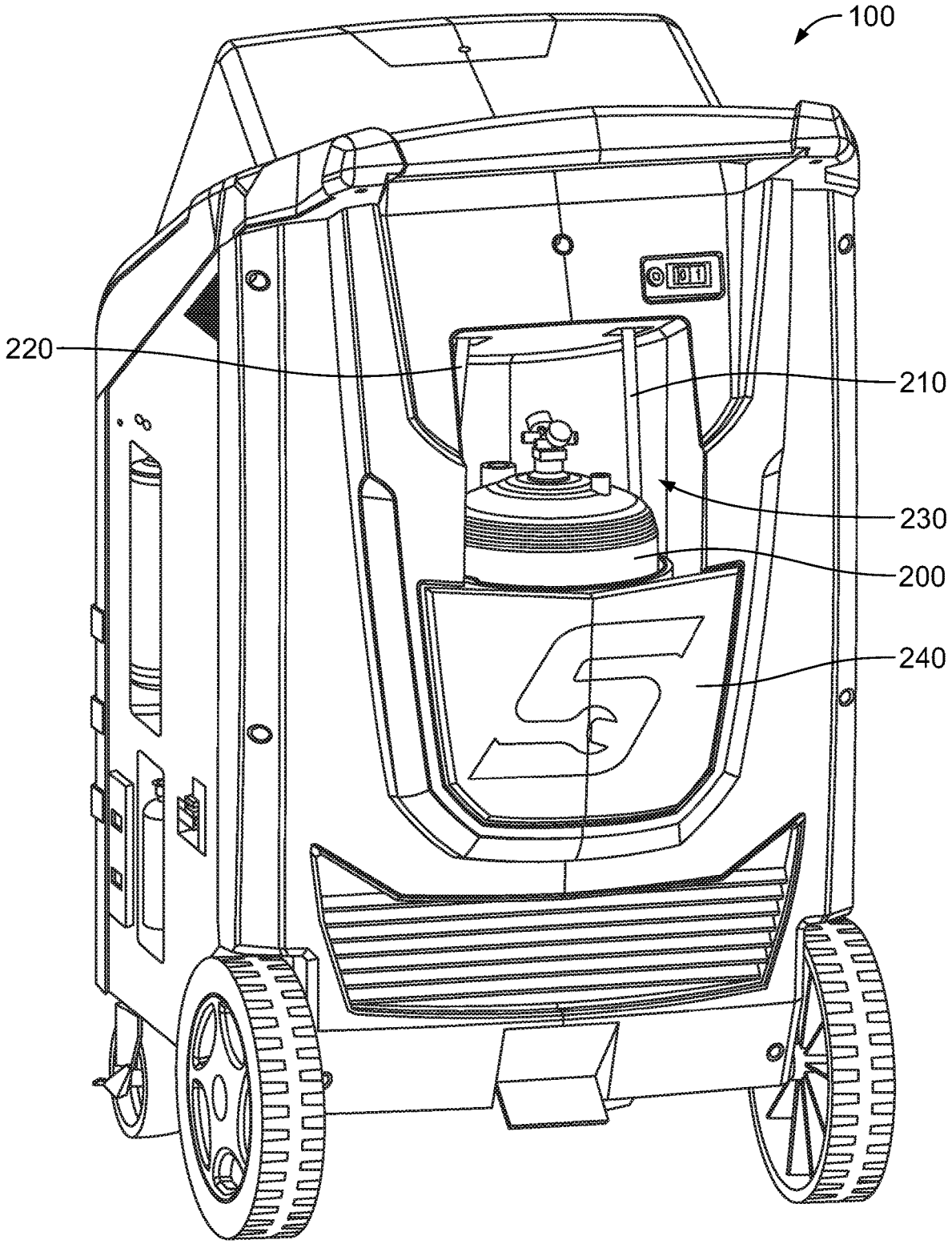
FIG. 1A is a perspective rear view of refrigerant delivery and recovery unit 100 shown with a refrigerant resupply tank 200, according to an example embodiment.
Figure 1B:
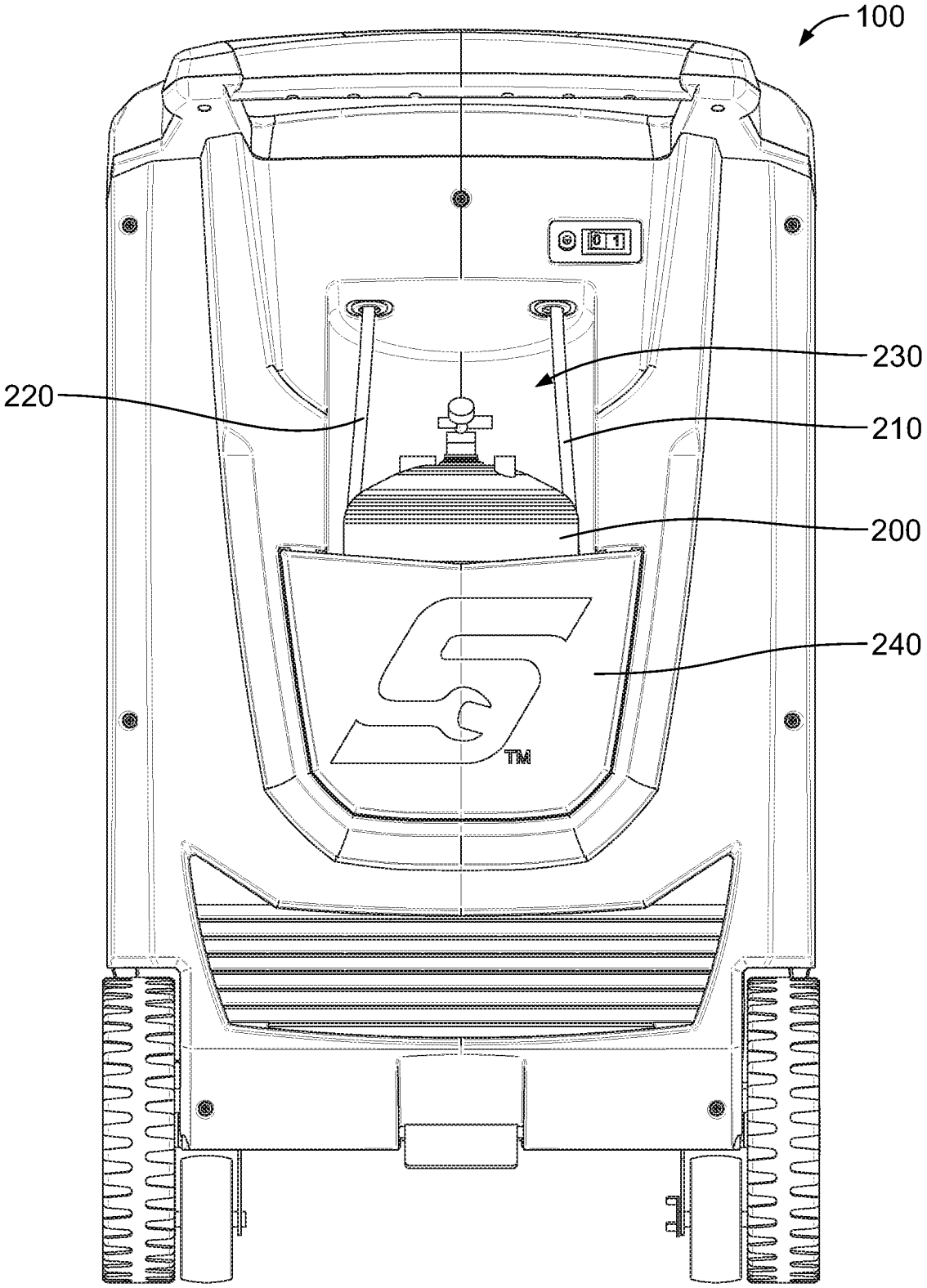
FIG. 1B is a rear view of refrigerant delivery and recovery unit 100 shown in FIG. 1A.

FIG. 1A is a perspective rear view of refrigerant delivery and recovery unit 100 having a refrigerant resupply tank 200 positioned within tank recess 230 and FIG. 1B is a rear view of delivery and recovery unit 100. As shown in FIGS. 1A and 1B, a tank guard 240 extends across tank recess 230 to partially enclose refrigerant resupply tank 200. A first refrigerant hose 210 extends into tank recess 230 and may be connected to a first fitting on refrigerant resupply tank 200. First refrigerant hose 210 also extends into refrigerant delivery and recovery unit 100 where it may be connected to a refrigerant delivery system 300 (shown in FIGS. 6 and 7) and in turn to a first refrigerant tank 350 (shown in FIG. 6) adapted to store a supply of a first type of refrigerant such as R-134a. A second refrigerant hose 220 also extends into tank recess 230 and may be connected to a second fitting on a different refrigerant resupply tank 200. Second refrigerant hose 220 also extends into refrigerant delivery and recovery unit 100 where it may be connected to the refrigerant delivery system 300 (shown in FIGS. 6 and 7) and in turn to a second refrigerant tank 360 (shown in FIG. 6) adapted to store a supply of a second type of refrigerant such as R-1234yf.

Figure 2A:
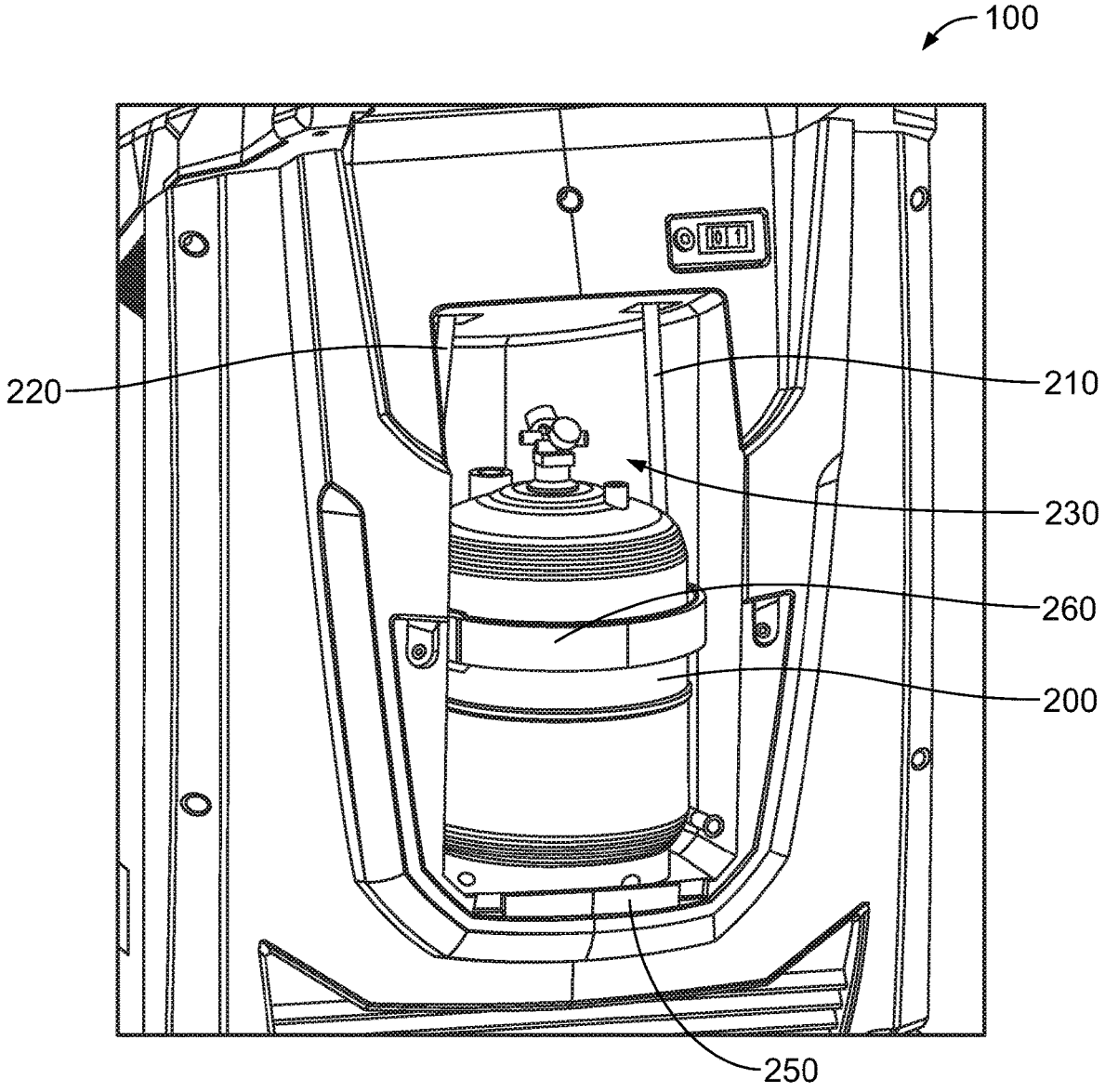
FIG. 2A is a close up perspective rear view of refrigerant delivery and recovery unit 100 shown in FIGS. 1A and 1B, with tank guard 240 removed, according to an example embodiment.
Figure 2B:
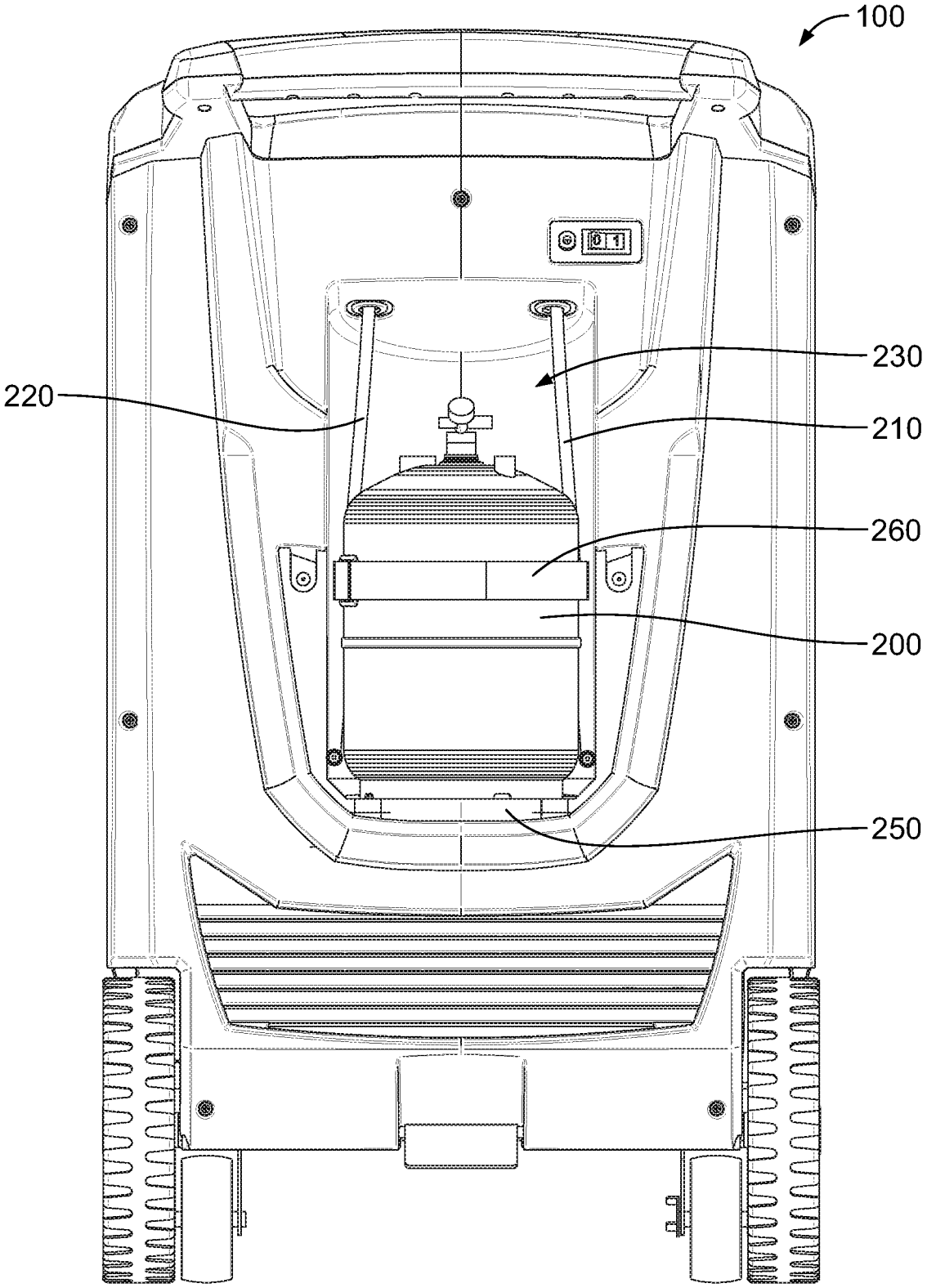
FIG. 2B is a rear view of refrigerant delivery and recovery unit 100 shown in FIG. 2A.

FIG. 2A is a close up perspective rear view of refrigerant delivery and recovery unit 100 shown in FIGS. 1A and 1B, with tank guard 240 removed and FIG. 2B is a rear view of refrigerant delivery and recovery unit 100 shown in FIG. 2A. Refrigerant resupply tank 200 is shown positioned within tank recess 230 and rests atop tank base 250. A tank strap 260 is positioned across tank recess 230 to secure refrigerant resupply tank 200 in tank recess 230.

Refrigerant resupply tank 200 may contain a first type of refrigerant, such as R-134a, and may be used to resupply first refrigerant tank 350 (shown in FIG. 6) with the first type of refrigerant (e.g. R-134a) through refrigerant hose 210. When it is desired to resupply the second refrigerant tank 360 (shown in FIG. 6) with a second type of refrigerant, such as R-1234yf, the refrigerant resupply tank 200 in tank recess 230 may be swapped out for a different refrigerant resupply tank containing a second type of refrigerant (e.g. R-1234yf). With the refrigerant resupply tank 200 containing the second type of refrigerant (e.g. R-1234yf) positioned within tank recess 230, the refrigerant resupply tank 200 may be used to resupply the second refrigerant tank 360 (shown in FIG. 6) through second refrigerant hose 220.

Refrigerant hoses 210 and 220 may be flexible rubber hoses that may be manipulated to allow for fittings 212 and 224 (shown most clearly in FIG. 4) on the ends of refrigerant hoses 210 and 220 to be connected to a corresponding fitting on a refrigerant resupply tank 200. For example, refrigerant resupply tank 200 is shown in Figures A-2B in an upright position, although it is possible for refrigerant resupply tank 200 to be rotated to an "upside down" position within tank recess 230. Whether refrigerant resupply tank 200 is in an upright position or in an "upside down" position, refrigerant hoses 210 and 220 are flexible to allow for the respective fitting 212 or 222 to be secured to a corresponding fitting on the refrigerant resupply tank 200.

As noted above, many vehicles on the road today utilize R-134a refrigerant, but in view of environmental regulations, the number of vehicles that utilize R-1234yf refrigerant has been increasing, and the number of vehicles using R-1234yf refrigerant is expected to increase further over time, and the number of vehicles using R-134a refrigerant is expect to decrease over time. As a result, given that vehicles utilizing either R-134a or R-1234yf refrigerant are both in operation, refrigerant delivery and recovery unit 100 advantageously includes two separate tanks of refrigerant, i.e., a first refrigerant tank 350 containing a first type of refrigerant (R-134a) and a second refrigerant tank 360 containing a second type of refrigerant (R-1234yf) so that vehicles requiring either type of refrigerant (R-134a or R-1234yf) may be resupplied by refrigerant delivery and recovery unit 100.

Figure 3:
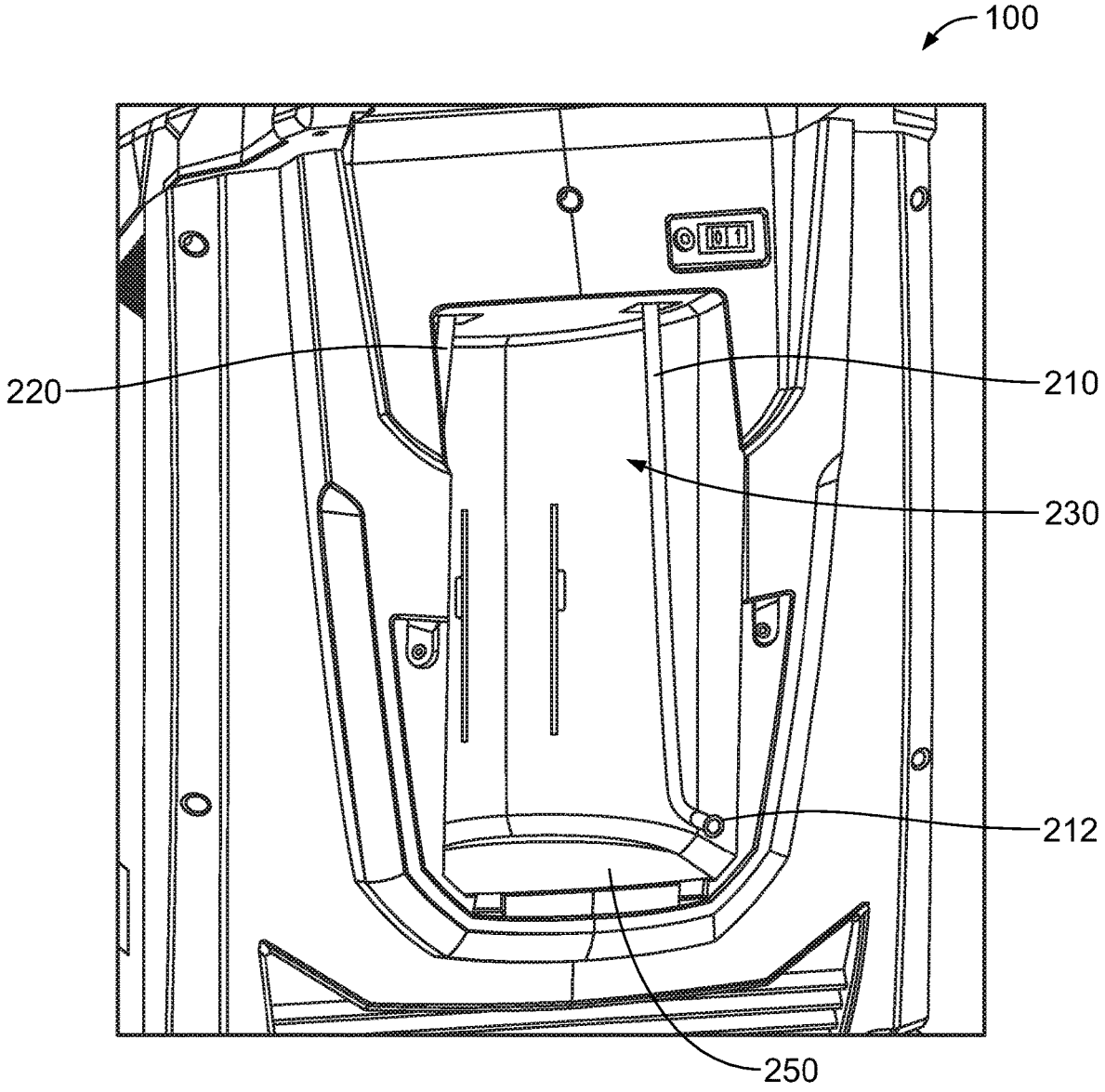
FIG. 3 is a close up perspective rear view of delivery and recovery unit 100 shown in FIGS. 1A-2B, with tank guard 240 and refrigerant resupply tank 200 removed.
Figure 4:
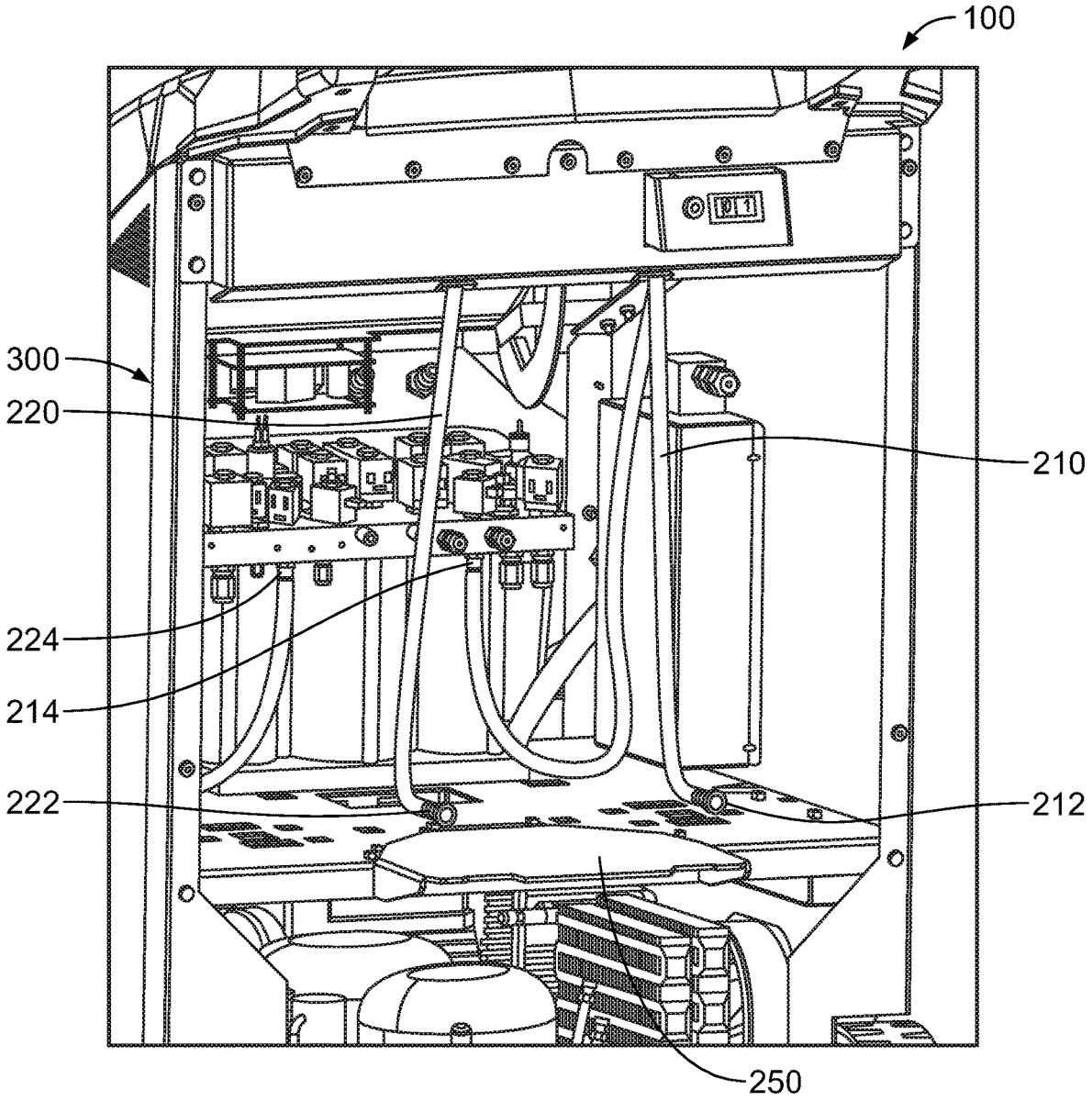
FIG. 4 is a close up perspective rear view of refrigerant delivery and recovery unit 100 shown in FIGS. 1A-3 with portions remove to show an inside view, according to an example embodiment.

FIG. 3 is a close up perspective rear view of delivery and recovery unit 100 shown in FIGS. 1A-2B, with tank guard 240 and refrigerant resupply tank 200 removed. FIG. 4 is a close up perspective rear view of refrigerant delivery and recovery unit 100 shown in FIGS. 1A-3 with portions removed to show an inside view. Referring to FIG. 3, a tank base 250 is shown at the bottom or tank recess 230, and is used as a base for refrigerant resupply tank 200. First refrigerant hose 210 extends downwardly into tank recess 230 where it may be attached to refrigerant resupply tank 200 (shown in FIGS. 1A-2B) when it is positioned within tank recess 230. First refrigerant hose 210 includes a first fitting 212 that is adapted to be secured to a corresponding first fitting on refrigerant resupply tank 200. Second refrigerant hose 220 also extends downwardly into tank recess 230 where it may be attached to a different refrigerant resupply tank 200 when it is positioned within tank recess 230. Second refrigerant hose 220 includes a second fitting 222 (shown in FIG. 4) that is adapted to be secured to a corresponding second fitting on a refrigerant resupply tank 200 containing the second type of refrigerant (e.g. R-1234yf).

Importantly, in order to insure that only the proper refrigerant can be resupplied from the refrigerant resupply tank 200 to the first refrigerant tank 350 (shown in FIG. 6) or to the second refrigerant tank 360 (shown in FIG. 6), the refrigerant delivery and recovery unit 100 includes a number of safeguards. As a first safeguard, when the refrigerant resupply tank 200 is adapted to store the first type of refrigerant (e.g. R-134a), and it is desired to resupply or refill the first refrigerant tank 350 containing the first type of refrigerant with the first type of refrigerant (e.g. R-134a), first refrigerant hose 210 that extends to the first refrigerant tank 350 has a fitting 212 that is configured to attach to a refrigerant resupply tank 200 containing the first type of refrigerant (e.g. R-134a). Fitting 212 is configured so that it is unable to be attached to a fitting on the refrigerant resupply tank 200 containing a second type of refrigerant (e.g. R-1234yf). As shown in FIG. 4, first refrigerant hose 210 also includes a second fitting 214 that is attached to refrigerant delivery system 300 to corresponding fitting on the refrigerant delivery system 300 that is adapted to supply a first type of refrigerant (e.g. R-134a) to the first refrigerant tank 350. Fitting 214 is also configured such that it may attach to the corresponding fitting on refrigerant delivery system 300 that supplies the first type of refrigerant (e.g. R-134a) to the first refrigerant tank 350.

Similarly, when the refrigerant resupply tank 200 is filled with the second type of refrigerant (e.g. R-1234yf), and it is desired to resupply or refill the second refrigerant tank 360 containing the second type of refrigerant with the second type of refrigerant (e.g. R1s34yf), refrigerant hose 220 that extends to the second refrigerant tank 360 has a fitting 222 that is configured to attach to a refrigerant resupply tank 200 containing the second type of refrigerant (e.g. R-1234yf). Fitting 222 is configured so that it is unable to be attached to a fitting on the refrigerant resupply tank 200 containing a first type of refrigerant (e.g. R-134a). As shown in FIG. 4, second refrigerant hose 220 also includes a second fitting 224 that is attached to refrigerant delivery system 300 to a corresponding fitting on the refrigerant delivery system 300 that is adapted to supply a second type of refrigerant (e.g. R-1234yf) to the second refrigerant tank 360. Fitting 224 is also configured such that it may attach to the corresponding fitting on refrigerant delivery system 300 that supplies the second type of refrigerant (e.g. R-1234yf) to the second refrigerant tank 360.

Thus, fitting 212 of first refrigerant hose 210 may have left-handed threads that attach to a corresponding left-handed threaded fitting on a refrigerant resupply tank 200 containing a first type of refrigerant (e.g. R-134a), and fitting 214 may have left-handed threads that attach to a corresponding left-handed threaded fitting on refrigerant delivery system 300 that leads to the first refrigerant tank 350 containing the first type of refrigerant (e.g. R-134a). In addition, fitting 222 of second refrigerant hose 220 may have right-handed threads that attach to a corresponding right-handed threaded fitting on a refrigerant resupply tank 200 containing a second type of refrigerant (e.g. R-1234yf) and fitting 224 may have right-handed threads that attach to a corresponding right-handed threaded fitting on refrigerant delivery system 300 that leads to the second refrigerant tank 360 containing the second type of refrigerant (e.g. R-1234yf).

The use of left-handed fittings for the first refrigerant hose 210 to connect to a refrigerant resupply tank 200 containing a first type of refrigerant (e.g. R-134a) and to connect to a fitting on refrigerant delivery system 300 that leads to the first refrigerant tank 350 containing the first refrigerant (e.g. R-134a), provides a safeguard insuring that only the first type of refrigerant (e.g. R-134a) is supplied from a refrigerant resupply tank 200 to first refrigerant tank 350. Similarly, the use of right-handed fittings for the second refrigerant hose 220 to connect to a refrigerant resupply tank 200 containing a second type of refrigerant (e.g. R-1234yf) and to connect to a fitting on refrigerant delivery system 300 that leads to the second refrigerant tank 360 containing the second refrigerant (e.g. R-1234yf), provides another safeguard insuring that only the second type of refrigerant (e.g. R-1234yf) is supplied from a refrigerant resupply tank 200 to second refrigerant tank 360.

It will be appreciated that rather than, or in addition to, using left-hand or right-hand threaded fittings to insure only the proper refrigerant is supplied to the first or second refrigerant tank, different sized fittings and/or different sized threads may also be used to insure that only the proper type of refrigerant is supplied to the first or second refrigerant tank.

Figure 5:
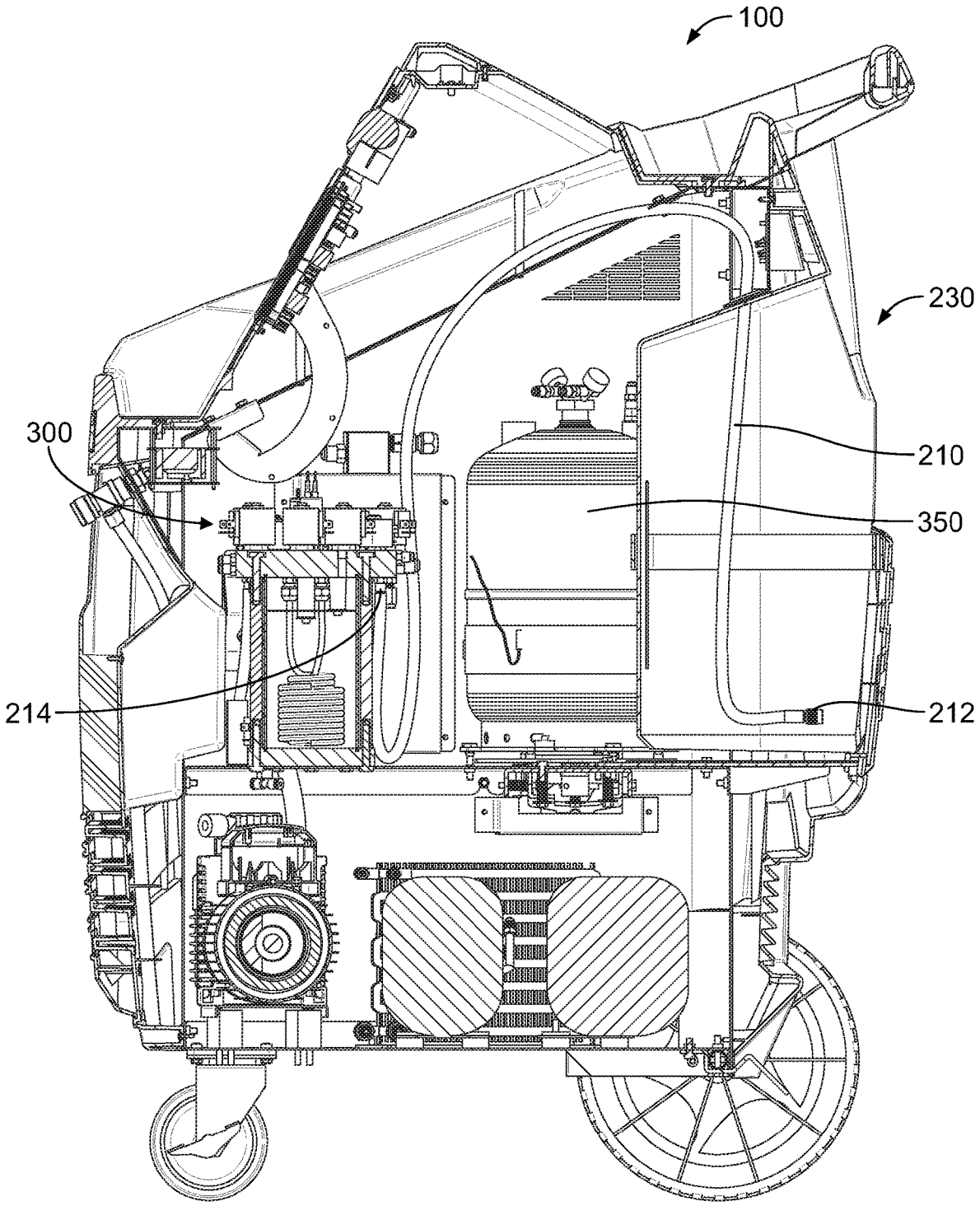
FIG. 5 is a cross-sectional right side view of refrigerant delivery and recovery unit 100 shown in FIGS. 1A-4, according to an example embodiment.

FIG. 5 is a cross-sectional right side view of refrigerant delivery and recovery unit 100 shown in FIGS. 1A-4. First refrigerant tank 350 is shown next to refrigerant delivery system 300. Tank recess 230 is shown without a refrigerant resupply tank positioned therein. First refrigerant hose 210 is shown having a first end having a fitting 212 extending into tank recess 230. A second end of first refrigerant hose 210 is shown having a fitting 214 attached to refrigerant delivery system 300 which provides a resupply of a first type of refrigerant (e.g. R-134a) to first refrigerant tank 350.

Figure 6:
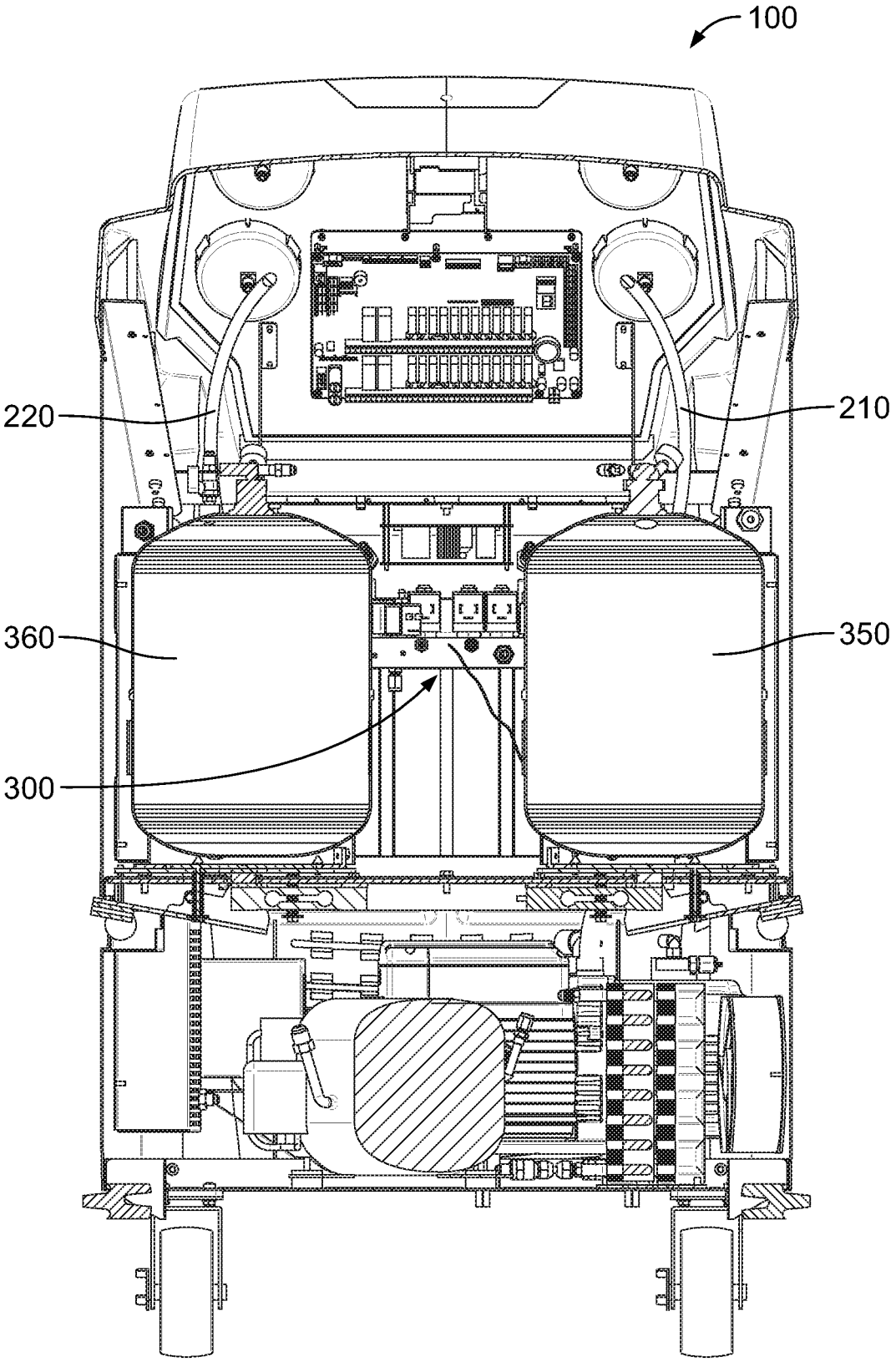
FIG. 6 is a cross-sectional rear view of refrigerant delivery and recovery unit 100 shown in FIGS. 1A-5, according to an example embodiment.

FIG. 6 is a cross-sectional rear view of refrigerant delivery and recovery unit 100 shown in FIGS. 1A-5. First and second refrigerant tanks 350, 360 are shown positioned within refrigerant delivery and recovery unit 100. In particular, first refrigerant tank 350 contains a first type of refrigerant (e.g. R-134a) and second refrigerant tank 360 contains a second type of refrigerant (e.g. R-1234yf). When it is desired to supply the first refrigerant tank 350 with the first type of refrigerant (e.g. R-134a), a refrigerant resupply tank 200 that contains the first type of refrigerant (e.g. R-134a) is placed within tank recess 230 (shown in FIG. 1A-2B). First refrigerant hose 210 is used to transfer the first type of refrigerant (e.g. R-134a) to refrigerant delivery system 300 and on to first refrigerant tank 350, thereby refilling first refrigerant tank 350 with the first type of refrigerant.

Second refrigerant tank 360 contains a second type of refrigerant (e.g. R-1234yf). When it is desired to refill the second refrigerant tank 360 with the second type of refrigerant (e.g. R-1234yf), the refrigerant resupply tank 200 used to resupply the first refrigerant tank 350 is unhooked from first refrigerant hose 210 and removed from the tank recess 230. Next, a refrigerant resupply tank 200 that contains the second type of refrigerant (e.g. R-1234yf) is placed within tank recess 230 (as shown in FIG. 1A-2B). Second refrigerant hose 220 is used to transfer the second type of refrigerant (e.g. R-1234yf) to refrigerant delivery system 300 and on to second refrigerant tank 360, thereby refilling second refrigerant tank 360 with the second type of refrigerant.

Figure 7:
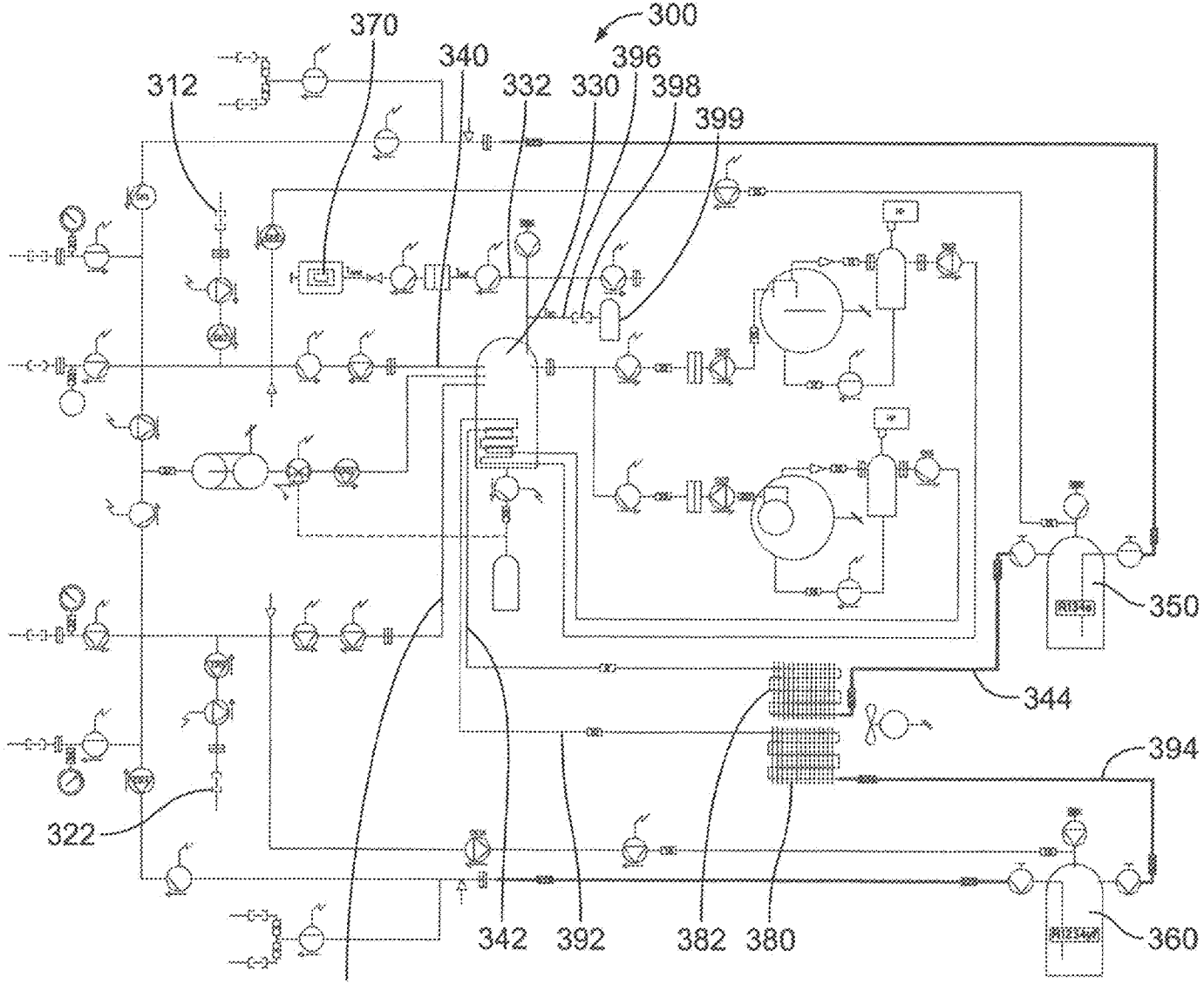
FIG. 7 is a schematic representation of the refrigerant delivery system 300 used in delivery and recovery unit 100 shown in FIGS. 1-6, according to an example embodiment.

FIG. 7 is a schematic representation of the refrigerant delivery system 300 used in delivery and recovery unit 100 shown in FIGS. 1A-6. In order to refill first refrigerant tank 350 shown containing a first refrigerant R-134a, a refrigerant resupply tank 200 (shown in FIGS. 1A-2B) containing first refrigerant R-134a is positioned in tank recess 230. Fitting 212 of first refrigerant hose 210 is attached to a corresponding fitting on refrigerant resupply tank 200. Fitting 214 of first refrigerant hose 210 is secured to corresponding fitting 312 on refrigerant delivery system 300 shown in FIG. 7. First refrigerant R-134a from refrigerant resupply tank 200 travels through first refrigerant hose 210 and through fitting 312 on refrigerant delivery system 300. The first refrigerant R-134a then travels through line 340 to oil separator 330, and then through line 332 to gas identifier 370. Gas identifier 370 chemically tests the refrigerant to verify that the refrigerant is the proper refrigerant to travel onward to first refrigerant tank 350. Once first refrigerant R-134a is identified as such by gas identifier 370, the supply of first refrigerant R-134a that enters oil separator 330 through line 340 is allowed to continue outwardly from oil separator 330 through line 342 to condenser 382 and then travels through line 344 to first refrigerant tank 350 to replenish the supply of first refrigerant R-134a in first refrigerant tank 350.

In similar fashion, in order to refill second refrigerant tank 360 shown containing a second refrigerant R-1234yf, a refrigerant resupply tank 200 (shown in FIGS. 1A-2B) containing second refrigerant R-1234yf is positioned in tank recess 230. Fitting 222 of second refrigerant hose 220 is attached to a corresponding fitting on refrigerant resupply tank 200. Fitting 224 of second refrigerant hose 220 is secured to corresponding fitting 322 on refrigerant delivery system 300. Second refrigerant R-1234yf from refrigerant resupply tank 200 travels through second refrigerant hose 220 and through fitting 322 on refrigerant delivery system 300. The second refrigerant R-1234yf then travels through line 390 to oil separator 330, and then on through line 332 to gas identifier 370. Gas identifier 370 chemically tests the refrigerant to verify that the refrigerant is the proper refrigerant to travel onward to second refrigerant tank 360. Once second refrigerant R-1234yf is identified as such by gas identifier 370, the supply of second refrigerant R-1234yf that enters oil separator 330 through line 390 is allowed to continue outwardly from oil separator 330 through line 392 to condenser 380 and then travels through line 394 to second refrigerant tank 360 to replenish the supply of second refrigerant R-1234yf in second refrigerant tank 360.

In this manner, gas identifier 370 provides a second safeguard (in addition to the use of right-handed and left-handed threaded fittings) to insure that the first and second refrigerant tanks 350, 360 are supplied only with the proper refrigerant.

In addition, a third safeguard may also be employed to insure that only the proper refrigerant is supplied to the first or second refrigerant tanks 350, 360 in the form of a pressure sensor which can be used to insure that only refrigerant coming through under pressure from the appropriate refrigerant resupply tank is ultimately routed to the designated refrigerant tank.

It will also be appreciated that refrigerant delivery system 300 is used to distribute both a first and a second type of refrigerant to the first and second refrigerant tanks respectfully. As a result, if first refrigerant tank 350 is resupplied with first refrigerant R-134a, and it desired to resupply second refrigerant tank 360 with second refrigerant R-1234yf, refrigerant delivery system 300 includes means to purge the system of residual refrigerant before supplying the second refrigerant tank 360 with second refrigerant R-1234yf. In particular, residual refrigerant may be forced or drawn through line 396 and through discharge fitting 398 that is secured to a refrigerant discharge tank. In this manner, residual refrigerant may be removed from refrigerant delivery system 300 into an approved discharge container which prevents discharge of any refrigerant to the atmosphere.

In addition, if gas identifier 370 determines that the wrong type of refrigerant has entered refrigerant delivery system 300, that refrigerant may be discharged through line 396 and through discharge fitting 398 into a discharge tank 399. Then the appropriate refrigerant may be connected for resupply to first of second refrigerant tank 350, 360, and further tested by gas identifier 370 confirm and verify that the proper refrigerant intended to he resupplied is identified by the gas identifier 370.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the claims, along with the full scope of equivalents to which such claims are entitled. It is also to be understood that the terminology used herein is for the purpose of describing particular embodiments only, and is not intended to be limiting.

What is claimed is:

1. An apparatus comprising:

a refrigerant tank housing;

a first storage tank positioned within the refrigerant tank housing;

a second storage tank positioned within the refrigerant tank housing;

a refrigerant delivery system comprising hoses and fittings positioned within the refrigerant tank housing, the refrigerant delivery system adapted to supply a first refrigerant to the first storage tank and a second refrigerant to the second storage tank;

a tank recess on the housing for receiving a refrigerant resupply tank therein;

a first refrigerant hose having a first fitting adapted for connection to a first refrigerant resupply tank;

a second refrigerant hose having a first fitting adapted for connection to a second refrigerant resupply tank;

wherein the first refrigerant hose is adapted for connection to the refrigerant delivery system;

wherein the second refrigerant hose is adapted for connection to the refrigerant delivery system;

wherein the first refrigerant hose is further adapted to supply the first refrigerant to the refrigerant delivery system from the first refrigerant resupply tank;

wherein the second refrigerant hose is further adapted to supply the second refrigerant to the refrigerant delivery system from the second refrigerant resupply tank;

wherein refrigerant supplied through the first refrigerant hose is directed to an oil separator through a first refrigerant line and directed from the oil separator through a second refrigerant line towards the first storage tank; and wherein refrigerant supplied through the second refrigerant hose is directed to the oil separator through a third refrigerant line and directed from the oil separator through a fourth refrigerant line towards the second storage tank.

2. The apparatus of claim 1, wherein the first refrigerant comprises R-134a and the second refrigerant comprises R-1234yf.

3. The apparatus of claim wherein threads on the first fitting of the first refrigerant hose are different than threads on the first fitting of the second refrigerant hose.

4. The apparatus of claim 3, wherein the threads on the first fitting of the first refrigerant hose are right-handed threads and the threads on the first fitting of the second refrigerant hose are left-handed threads.

5. The apparatus of claim 1, wherein when the first refrigerant resupply tank containing the first refrigerant is secured within the tank recess, the first fitting of the first refrigerant hose is secured to the first refrigerant resupply tank, a second fitting of the first refrigerant hose is secured to a first fitting on the refrigerant delivery system, and the refrigerant delivery system is connected to the first storage tank.

6. The apparatus of claim 5, wherein the refrigerant delivery system includes a gas identifier wherein when refrigerant is introduced into the refrigerant delivery system from the first refrigerant resupply tank, the refrigerant is identified by the gas identifier to insure that only a proper refrigerant is supplied to the first storage tank.

7. The apparatus of claim 6, wherein the gas identifier can determine that the first refrigerant supplied by the first refrigerant resupply tank is the proper refrigerant, and the refrigerant delivery system is adapted to deliver the first refrigerant to the first storage tank.

8. The apparatus of claim 6, wherein the refrigerant delivery system includes a discharge fitting adapted for attachment to a discharge tank such that refrigerant within the refrigerant delivery system may be purged through the discharge fitting to the discharge tank.

9. The apparatus of claim 8, wherein the gas identifier can determine that the first refrigerant supplied by the first refrigerant resupply tank is not the proper refrigerant, and the refrigerant the refrigerant delivery is system is purged through to the discharge fitting to the discharge tank.

10. An apparatus, comprising:

a refrigerant tank housing;

a first storage tank positioned within the refrigerant tank housing;

a second storage tank positioned within the refrigerant tank housing;

a refrigerant delivery system comprising hoses and fittings positioned within the refrigerant tank housing, refrigerant delivery system adapted to supply a first refrigerant to the first storage tank and a second refrigerant to the second storage tank;

a refrigerant resupply tank positionable in the housing;

a first refrigerant hose having a first fitting adapted for connection to a first refrigerant resupply tank;

a second refrigerant hose having a first fitting adapted for connection to a second refrigerant resupply tank;

wherein the first refrigerant hose is adapted for connection to the refrigerant delivery system;

wherein the second refrigerant hose is adapted far connection to the refrigerant delivery system;

wherein the first refrigerant hose is further adapted to supply the first refrigerant to the refrigerant delivery system from the first refrigerant resupply tank; and wherein the second refrigerant hose is further adapted to supply the second refrigerant to the refrigerant delivery system from the second refrigerant resupply tank wherein refrigerant supplied through th first refrigerant hose is directed to an oil separator through a first refrigerant line and directed from the oil separator through a second refrigerant line towards the first storage tank; and wherein refrigerant supplied through the second refrigerant hose is directed to the oil separator through a third refrigerant line and directed from the oil separator through a fourth refrigerant line towards the secord storage tank.

11. A method, comprising;

providing a refrigerant supply unit having a refrigerant tank housing having a first storage tank positioned within the refrigerant tank housing and a second storage tank positioned within the refrigerant tank housing, a refrigerant delivery system comprising hoses and fittings positioned within the refrigerant tank housing, the refrigerant delivery system adapted to supply a first refrigerant to the first storage tank and a second refrigerant to the second storage tank, the housing adapted for receiving a refrigerant resupply tank therein, a first refrigerant hose having a first fitting adapted for connection to a first refrigerant resupply tank, a second refrigerant hose having a first fitting adapted for connection to a second refrigerant resupply tank, wherein the first refrigerant hose is adapted for connection to the refrigerant delivery system, wherein the second refrigerant hose is adapted for connection to the refrigerant delivery system, wherein the first refrigerant hose is further adapted to supply the first refrigerant to the refrigerant delivery system from the first refrigerant resupply tank, and wherein the second refrigerant hose is further adapted to supply the second refrigerant to the refrigerant delivery system from the second refrigerant resupply tank, wherein refrigerant supplied through the first refrigerant hose is directed to an oil separator through a first refrigerant line and directed from the oil separator through a second refrigerant line towards the first storage tank; and wherein refrigerant supplied through the second refrigerant hose is directed to the oil separator through a third refrigerant line and directed from the oil separator through a fourth refrigerant line towards the second storage tank;

securing a first refrigerant resupply tank containing the first refrigerant in the housing;

attaching the first fitting of the first refrigerant hose to the first refrigerant resupply tank, and attaching the second fitting of the first refrigerant hose to a first fitting on the refrigerant delivery system, wherein the first refrigerant hose is connected to the refrigerant delivery system and the refrigerant delivery system is connected to the first storage tank; and supplying the first refrigerant from the first refrigerant resupply tank through the first refrigerant hose and the refrigerant delivery system to the first storage tank.

12. The method of claim 11, wherein the first refrigerant comprises R-134a and the second refrigerant comprises R-1234yf.

13. The method of claim 11, wherein threads on the first fitting of the first refrigerant hose are different than threads on the first fitting of the second refrigerant hose.

14. The method of claim 13, wherein the threads on the first fitting of the first refrigerant hose are right-handed threads and the threads on the first fitting of the second refrigerant hose are left-handed threads.

15. The method of claim 11, wherein the refrigerant delivery system includes a gas identifier, wherein the method further comprises directing the first refrigerant from the first refrigerant resupply tank through the refrigerant delivery system to the gas identifier, and wherein the first refrigerant is identified by the gas identifier to insure that only a proper refrigerant is supplied to the first storage tank.

16. The method of claim 15, wherein when the gas identifier determines that the first refrigerant supplied by the first refrigerant resupply tank is the proper refrigerant, the refrigerant delivery system delivers the first refrigerant to the first storage tank.

17. The method of claim 16, wherein the refrigerant delivery system includes a discharge fitting attatched to a discharge tank and further including the step of purging refrigerant from within the refrigerant delivery system through the discharge fitting to the discharge tank.

18. The method of claim 17, wherein when the gas identifier determines that the first refrigerant supplied by the first refrigerant resupply tank is not the proper refrigerant, the refrigerant in the refrigrant delivery system is purged through the discharge fitting to the discharge tank.

19. The method of claim 11, further comprising:

disconnecting the first refrigerant resupply tank from the first refrigerant hose and removing the first refrigerant resupply tank from the tank recess;

securing a second refrigerant resupply tank containing a second refrigerant within the tank recess;

attaching the first fitting of the second refrigerant hose to the second refrigerant resupply tank, wherein the second refrigerant hose is connected to the refrigerant delivery system and the refrigerant delivery system is connected to the second storage tank; and supplying the second refrigerant from the second refrigerant resupply tank through the second refrigerant hose and the refrigerant delivery system to the second storage tank.

20. The method of claim 19, wherein the refrigerant delivery system includes a gas identifier, wherein the method comprises directing the second refrigerant from the second refrigerant resupply tank through the refrigerant delivery system to the gas identifter, and wherein the second refrigerant is identified by the gas identifier to insure that only the proper refrigerant is supplied to the second storage tank.

* * * * *